United States Patent [19]

Nozawa et al.

[11] 4,269,572

[45] May 26, 1981

[54] ELECTROMAGNETIC PLUNGER PUMP

[75] Inventors: Katsumi Nozawa; Hideo Nomura, both of Yokohama, Japan

[73] Assignee: Taisan Industrial Co., Ltd., Tokyo, Japan

[21] Appl. No.: 30,301

[22] Filed: Apr. 16, 1979

[51] Int. Cl.[3] ..... F04B 49/00; F04B 17/04

[52] U.S. Cl. ..... 417/299; 417/308; 417/435; 417/417; 137/110

[58] Field of Search ..... 417/299, 308, 435, 417; 137/110

[56] References Cited

U.S. PATENT DOCUMENTS

| | | | |
|---|---|---|---|
| 2,362,724 | 11/1944 | Shea | 417/299 X |
| 2,442,361 | 6/1948 | Hulman | 417/299 X |
| 2,469,362 | 5/1949 | Bashark | 417/299 X |
| 3,948,147 | 4/1976 | Sauer et al. | 417/299 X |
| 4,021,152 | 5/1977 | Toyoda | 417/311 |

*Primary Examiner*—Richard E. Gluck

[57] ABSTRACT

An electromagnetic plunger pump of the reciprocating type including a vent valve means which allows only air bubbles in the pump to pass therethrough. This vent valve means is provided in a pressure adjusting plunger fitted in a pressure adjusting cylinder for reciprocating motion. The vent valve means comprises a vent valve rod which is fitted in a through-hole of the pressure adjusting plunger so as to form a passage about the vent valve rod, and a vent valve body which is normally energized by a spring in the direction away from a vent valve seat at a forward end of the pressure adjusting plunger to provide a clearance between the vent valve body and the vent valve seat. This clearance is such that it allows the air bubbles to pass therethrough, while it does not allow a liquid under pressure having a viscosity to pass therethrough with the result that the vent valve means is closed by such liquid under pressure. The air bubbles and the excess liquid under pressure from the pressure adjusting mechanism are returned to a storage tank.

4 Claims, 5 Drawing Figures

ELECTROMAGNETIC PLUNGER PUMP

BACKGROUND OF THE INVENTION

This invention relates to an electromagnetic plunger pump, and more particularly it is concerned with an electromagnetic plunger pump of the reciprocating type having therein a means for preventing the flow passage in the pump from being blocked up with air bubbles.

Generally, such reciprocating type of electromagnetic plunger pump is small in the diameter of a delivery piston or in the cross-sectional area of a cylinder and short in the length of stroke. Accordingly, when the electromagnetic plunger pump is used to draw kerosene or light oil from a storage tank located below the pump to feed it under pressure to a gasoline type burner and spray it therein for ignition and subsequent burning, it is usually increased in the number of stroke per unit time to maintain the delivery amount and is made considerably smaller in the delivery volume in comparison with the size of a valve chamber. Such pump is so-called a pump of lower volume efficiency. The air contained in the fuel oil and the gas gasified from the flowing oil due to the pumping action merely repeat the expansion and compression thereof by the reciprocating motion of the delivery piston, thereby causing a vapour lock phenomenon which obstructs a pumping action comprising the suction and discharge of the fuel oil.

U.S. Pat. No. 3,877,841 and U.S. Pat. No. 4,021,152 disclose the electromagnetic plunger pumps of the type in which after adjusting the pressure by a pressure adjusting mechanism in the form of relief valve built in the pump, the excess liquid under pressure of the pump is returned to the side of the suction valve of the pump. Particularly, in U.S. pat. No. 4,021,152, the electromagnetic plunger pump is provided with a means for preventing a vapour lock phenomenon comprising a particular duct for returning the excess liquid under pressure due to the adjustment of pressure to the side of the suction valve to thereby convert the air bubbles into comminuted form and return to the suction side without stagnation of the air bubbles. However, if the air bubbles enter into the side of the suction valve of such pump from the pipe at the suction side, it will cause a vapour lock phenomenon and further the air bubbles will be circulated in the pump and not easily discharged from the pump, so that the decrease in the delivery force of the pump and the stoppage of the pumping action frequently produce troubles due to the discontinuation of the fuel oil in burners or combustion apparatuses.

This is mostly because the above-mentioned type of pump which is of so-called an internal circulation system can draw the oil only the amount equal to that discharged, and merely repeats the compression and expansion of the air bubbles from the pressure chamber defined by the piston and the cylinder toward the discharge opening, so that the discharge of the air bubbles requires considerably long time and for such a period of time, the feed of the fuel oil is discontinued with the result that the fire is extinguished.

It is therefore a main object of the invention to provide an electromagnetic plunger pump in which the air bubbles existing or produced in the suction pipe can be rapidly treated to prevent the discontinuation of discharge of the fuel oil from the delivery side of the pump.

It is another object of the invention to provide an electromagnetic plunger pump having a vent valve means which allows the air bubbles to pass therethrough at a relatively lower pressure but does not allow the liquid under pressure having a viscosity to pass therethrough.

It is a further object of the invention to provide an electromagnetic plunger pump in which the excess liquid under pressure from the pressure adjusting mechanism is returned to a tank on exceeding a predetermined pressure to thereby increase the sum of the discharge amount at the delivery side and the return amount, i.e. the suction amount from the suction side, so that a vapour lock phenomenon may be prevented.

According to one aspect of the invention, there is provided an electromagnetic plunger pump comprising a pump body, an electromagnetic coil, a plunger case arranged on the longitudinal axis of the electromagnetic coil, an electromagnetic plunger fitted in the plunger case for reciprocating motion by the alternating action of the magnetic attractive force produced by intermittent current flowing through the electromagnetic coil and the biasing force of springs, and a pressure adjusting mechanism in the form of a relief valve provided in the pump body and normally shutting off a passage leading to the delivery side of the pump from a pressure adjusting chamber, wherein said pressure adjusting mechanism is provided with a vent valve means which allows only the air bubbles set free from a liquid under pressure to pass therethrough and which shuts off the liquid under pressure having a viscosity, and a duct which opens in the pressure adjusting chamber and a return opening flow connected to the duct are provided in the pump body to discharge the air bubbles and the excess liquid under pressure from the pressure adjusting mechanism outwardly of the pump.

Other objects and aspects of the invention will become apparent from the following description of embodiments with reference to the accompanying drawings in which.

DESCRIPTION OF THE PREFERRED EMBODIMENTS

Figure 1:
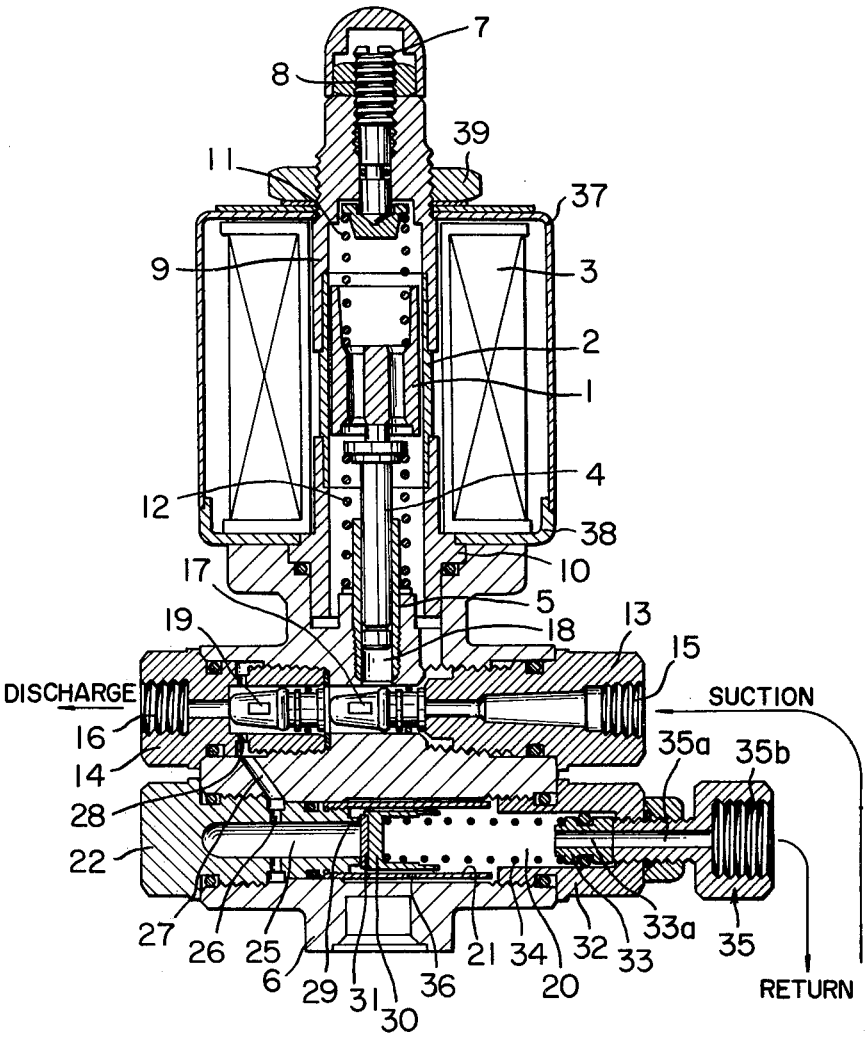
FIG. 1 is a vertical sectional view of an embodiment of the invention.

FIG. 1 shows an embodiment of an electromagnetic plunger pump according to the invention in which the excess liquid under pressure discharged from a pressure adjusting mechanism is returned to a storage tank outside a pump body to thereby increase the suction amount from a suction opening of the pump so that the air bubbles in the suction pipe may be rapidly drawn into the pump and passed through the pump at a higher flow rate for discharge outside the pump. In FIG. 1, an electromagnetic plunger 1 is mounted for sliding reciprocating motion in a plunger case 2 made of a non-magnetic material and enclosed by an electromagnetic coil 3. The electromagnetic plunger 1 is connected to a delivery piston 4 adapted to move in sliding reciprocating motion in a cylinder 5 mounted in a main body 6 and having a center axis vertically aligned with the center axis of the plunger case 2. An upper spring seat 7 is attached to an adjusting rod 8 threadably fitted in an upper magnetic path 9 mounted on an upper portion of the plunger case 2 in airtight relation. A lower magnetic path 10 is mounted on a lower portion of the plunger case 2 in airtight relation. An upper spring 11 is mounted between the spring seat 7 and an upper end of the magnetic plunger 1, while a lower spring 12 is mounted around the delivery piston 4. Since the biasing forces of the two springs 11 and 12 are equal in magnitude, the magnetic plunger 1 and the delivery piston 4 press against each other with the same force and supported in a predetermined position.

The main body 6 has a suction joint 13 and an outlet joint 14 threadably connected thereto. The suction joint 13 is formed therein with a suction opening 15 and the outlet joint 14 with a delivery opening 16. A suction valve 17 is arranged between a pressure chamber 18 formed in a lower portion of the cylinder 5, and a discharge valve 19 is arranged in the outlet joint 14 adjacent the suction valve 17.

A pressure adjusting chamber 20 is formed in the main body 6, and a pressure adjusting cylinder 21 is threadably connected to a plug 22 screwed in the body 6. The plug 22 is formed with a bore 25 along the axis thereof which communicates through a port 26 in the plug 22 and an angling duct 27 is the body 6 with a port 28 formed in the outlet joint 14. The plug 22 has a valve seat 29 for a pressure adjusting plunger 30 about the bore 25.

The pressure adjusting plunger 30 is mounted for sliding reciprocating motion in the pressure adjusting cylinder 21 and has attached to its forward end a valve body 31 which is adapted to be brought into engagement with the valve seat 29 to shut off the interior of the pressure adjusting cylinder 21 from the bore 25.

The pressure adjusting chamber 20 has a pressure adjusting screw cover 32 screwed in an end portion thereof. The pressure adjusting screw cover 32 has a center axis which is horizontally aligned with the center axis of the pressure adjusting cylinder 21. A pressure adjusting spring seat 33 is provided inside the pressure adjusting screw cover 32, and a pressure adjusting spring 34 is mounted between a forward end of the pressure adjusting spring seat 33 and the pressure adjusting plunger 30. A return joint 35 having a through-hole **35*a* and a return opening 35*b* flow connected thereto is threadably inserted in the pressure adjusting screw cover 32 and maintained at its forward end in engagement with a rear end of the spring seat 33 having a through-hole 33*a*. Thus, by turning the return joint 35, it is possible to vary the biasing force of the pressure adjusting spring 34 so as to adjust the force with which the valve body 31 is brought into pressing engagement with the valve seat 29**.

An orifice port 36 is formed in a suitable position in the pressure adjusting cylinder. 21 and opens in the pressure adjusting chamber 20. A coil cover 37 providing cover to the electromagnetic coil 3, a lower plate 38 held between a lower end of the electromagnetic coil 3 and the magnetic path 10, and the magnetic path 9 constitute a yoke which is held in position by a clump nut 39.

Figure 2:
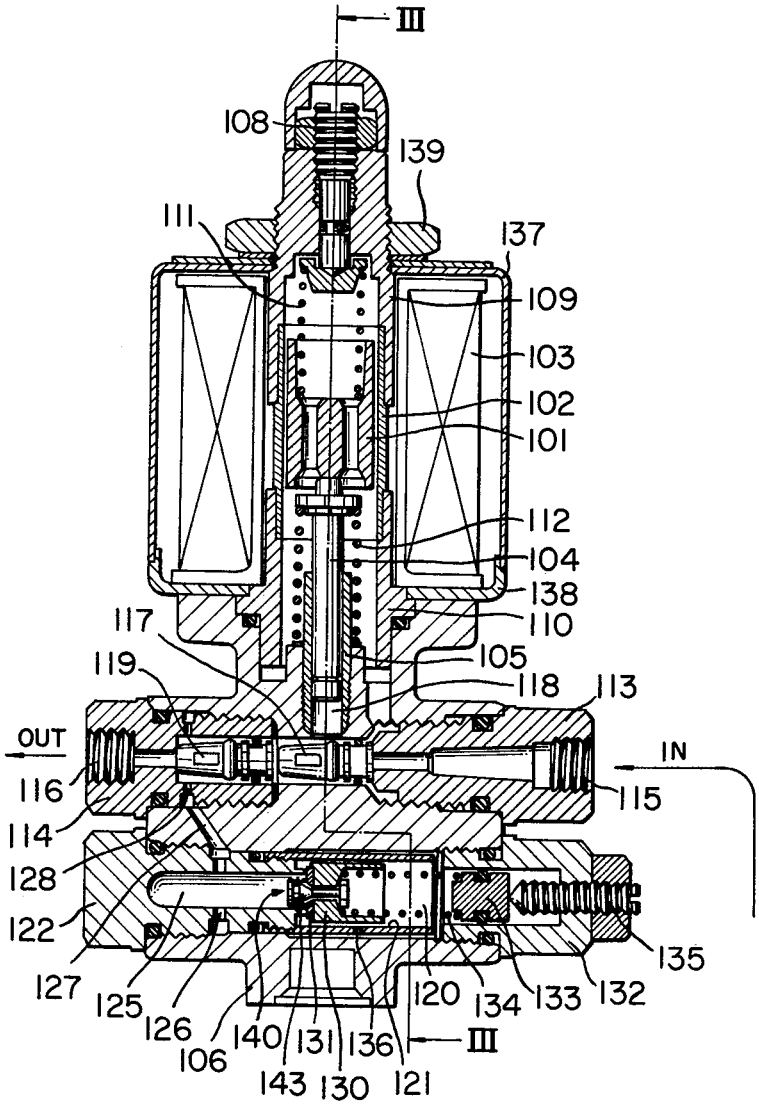
FIG. 2 is a vertical sectional view of a further embodiment of the invention.
Figure 3:
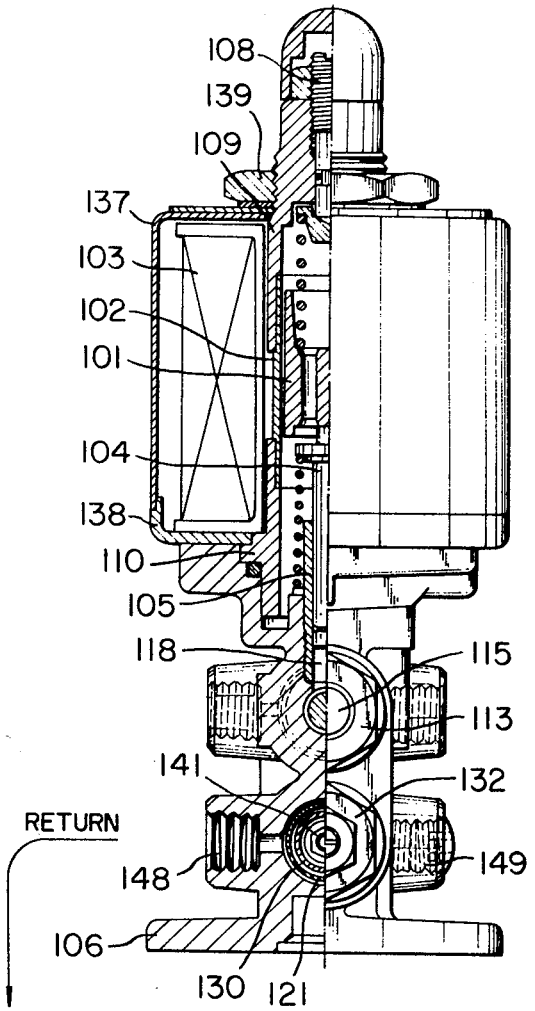
FIG. 3 is a side elevational view, partly in vertical section taken along the line III—III of FIG. 2, of the electromagnetic plunger pump shown in FIG. 2.

FIGS. 2 and 3 show a further embodiment of the invention in which in addition to a return opening flow connected to a storage tank outside the pump, a vent valve means 140 is provided at a forward end of the pressure adjusting plunger 130. In the drawings, like parts are designated by like reference characters.

Figure 4:
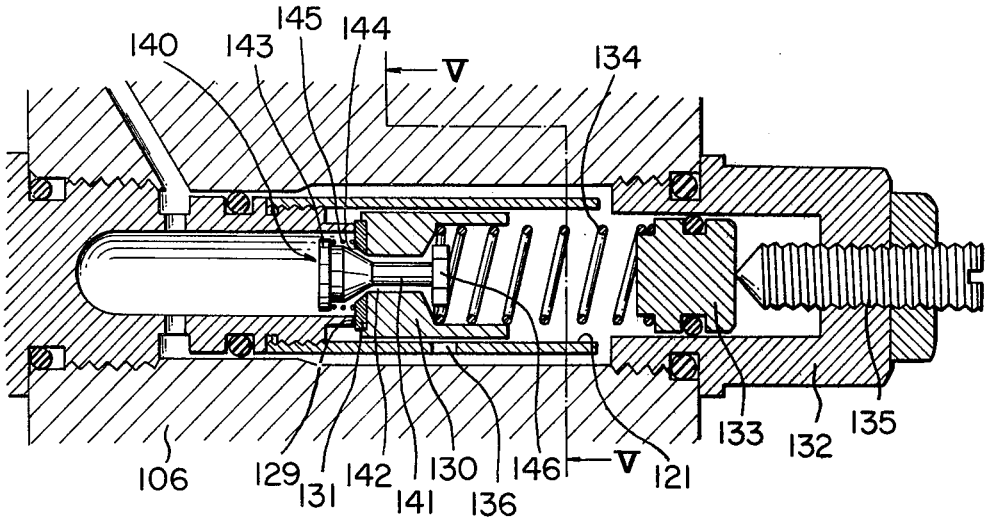
FIG. 4 is an enlarged detailed sectional view of the essential portion of the invention showing the vent valve means incoorporated in the pressure adjusting plunger.

This embodiment differs from the first embodiment shown in FIG. 1 in that the vent valve means 140 is provided in the pressure adjusting mechanism and the return opening 148 is provided in the pump body 106 while a pressure adjusting screw 135 is employed in place of the return joint 35 in the first embodiment. Particularly referring to FIGS. 4 and 5, the vent valve means 140 comprises a valve rod 141 which is fitted in a through-hole of the pressure adjusting plunger 130 so as to form an annular passage 142 about the vent valve rod 141, and a vent valve body 143 provided integrally at one end of the valve rod 141 and having a male tapered surface. The vent valve body 143 constitutes a composite valve mechanism with the pressure adjusting plunger 130 and is normally biased in the direction away from a vent valve seat 144 by a vent valve spring 145 with a considerably light load so that the vent valve means 140 is opened with an extremely small clearance between the male tapered surface of the vent valve body 143 and the female tapered surface of the vent valve seat 144. This clearance is such that it allows the air bubbles to pass therethrough, but it does not allow the fuel oil under pressure having a relatively higher viscosity to pass therethrough because it increases in tightness due to the oil film, so that the oil pressure, when applied to the vent valve body 143, moves the same toward the vent valve seat 144 against the spring 145, thereby closing the vent valve means 140. This is due to the same reason with the case of suction pumps which can not draw a liquid without priming.

Since this type of electromagnetic plunger pump is lower in volume efficiency and therefore in compression ratio as mentioned above, a gas which can be contracted in volume by the force of compression is lower in the delivery volume and pressure provided by the pumping action, so that it may be discharged through the clearance between the vent valve body 143 and the vent valve seat 144. On the other hand, a liquid which can be hardly contracted in volume by the force of compression causes an increase in the delivery volume and pressure, which overcomes the biasing force of the vent valve spring 145 to thereby move the vent valve body 143 toward the vent valve seat 144, thus closing the vent valve means 140, and any further increase in the delivery pressure of the liquid over a predetermined pressure moves the pressure adjusting plunger 130 away from the valve seat 129 to the right in the drawing. Preferably, the vent valve seat 144 is somewhat greater in the cone angle of the tapered surface than the vent valve body 143 so that the positive intimate contact therebetween may be made along a circle line.

Figure 5:
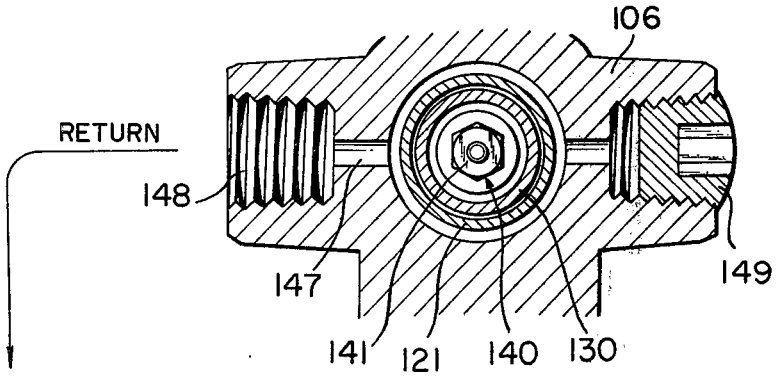
FIG. 5 is a fragmentary sectional view taken along the line V—V of FIG. 4.

The vent valve rod 141 has a nut 146 screwed thereon at the end opposite to the vent valve body 143. Referring to FIG. 5, ducts 147 which open into the pressure adjusting chamber 120 in opposite relation to each other are provided in the body 106 and flow connected to the respective return opening 148 one of which is closed by a blind plug 149.

Now, the operation of the electromagnetic plunger pump according to the invention will be described about the second embodiment.

Upon the electromagnetic coil 103 being excited by passing an electric current thereto, the electromagnetic plunger 101 and the delivery piston 104 are moved by the magnetic force toward the magnetic path 110 or downwardly in FIG. 2 in the plunger case 102 and the cylinder 105 respectively from the positions in which the plunger 101 and the piston 104 are supported due to the balancing of the biasing forces of the springs 111 and 112. Upon the electromagnetic current being cut off from the coil 103, the magnetic force is removed or greatly damped and the electromagnetic plunger 101 and the delivery piston 104 are restored to the original positions by the biasing force of the lower spring 112, thereby completing one reciprocating stroke of the plunger 101 and the piston 104. With the suction valve 117 and the discharge valve 119 performing an ancillary action, the piston 104 performs a pumping action by moving in reciprocating motion. Thus liquid is drawn by suction to move through an opening 115 of the suction joint 113, the suction duct and the suction valve 117 into the pressure chamber 118, from which the liquid is discharged through the discharge valve 119 and a delivery opening 116 of the outlet joint 114.

During the operation of the pump, a part of the air bubbles drawn into the pump is discharged from the delivery opening 116 and the greater part of the air bubbles is passed through the port 128, the angling duct 127, the port 126 and the bore 125 and subsequently through the clearance between the vent valve body 143 and the vent valve seat 129 and then the annular passage 142 into the pressure adjusting chamber 120, and discharged through the duct 147 and the return opening 148 outwardly of the pump. Then, the pressure of the fuel oil moves the vent valve body 143 toward the vent valve seat 144 against the vent valve spring 145 to thereby close the vent valve means 140 for the reason mentioned above. If there is a variation in the voltage impressed on the electromagnetic coil 103 of the pump or a discharge nozzle of the pump has its area changed to throttle the flow of liquid, the pressure in the pressure chamber 118 under the delivery piston 104 will become higher than the delivery pressure of the pump which is set at a predetermined value. If this is the case, the excess liquid under pressure will move the pressure adjusting plunger 130 with the vent valve means 140 closed to the right in FIG. 2 or 4 by overcoming the biasing force of the pressure adjusting spring 134 till the pressure adjusting plunger 130 opens the orifice port 136 located in a suitable position on the pressure adjusting cylinder 121. Then the excess liquid under pressure will flow through the orifice port 136 into the pressure adjusting chamber 120 and is discharged through the duct 147 and the return opening 148 outwardly of the pump and returned to a storage tank (not shown) located at a level lower than the pump.

In general, the return amount of the excess liquid under pressure from the pressure adjusting mechanism is several times as large as the delivery amount from the delivery opening 116 of the pump. Consequently, when the return amount of the excess liquid under pressure is returned to the storage tank outside the pump, the flow rate at the suction side of the pump will be several times as large as the internal circulation system in the prior art so that the liquid in the suction pipe increases in the flow rate to thereby rapidly draw the air bubbles in the suction pipe into the pump and discharge from the delivery opening 116 of the pump as well as from the return opening 148 of the pressure adjusting chamber 120 to the storage tank.

With the electromagnetic plunger pump according to the invention, the vent valve means provided in the pressure adjusting mechanism allows only the air bubbles to pass therethrough at a relatively lower pressure to return them to the storage tank outside the pump, and at a pressure over a predetermined pressure the excess pressure liquid produced by the operation of the pressure adjusting mechanism with the vent valve means closed due to the liquid under pressure having a viscosity is returned to the tank outside the pump, whereby the suction amount of the pump may be increased and the air bubbles in the fuel oil entering into the pump from the suction pipe may be rapidly passed through the suction valve, the pressure chamber under the piston and the delivery valve in a state mixed with the fuel oil and is discharged outwardly of the pump. In this way, a vapour lock phenomenon can be positively prevented from occuring.

As many apparently widely different embodiments of this invention may be made without departing from the spirit and scope thereof, it is to be understood that the invention is not limited to the specific embodiment thereof except as defined in the appended claims.

What is claimed is:

1. An electromagnetic plunger pump for delinering liquid comprising: a pump body, an electromagnetic coil, a plunger case arranged on the longitudinal axis of the electromagnetic coil, and electromagnetic plunger fitted in the plunger case for reciprocating motion by the alternating action of the magnetic attractive force produced by intermittent current flowing through the electromagnetic coil and the biasing force of springs, and a pressure adjusting mechanism comprising a pressure adjusting cylinder provided in the pump body, a pressure adjusting plunger fitted in the pressure adjusting cylinder for reciprocating motion and normally shutting off a passage leading to the delivery side of the pump from a pressure adjusting chamber which leads to a return opening of the pump body, wherein said pressure adjusting plunger is provided with a vent valve means which comprises a vent valve rod inserted in a through-hole of the pressure adjusting plunger so as to form an annular passage about the vent valve rod, a vent valve seat formed at the forward end of the pressure adjusting plunger, and a vent valve body integrally connected with said vent valve rod and concentrical therewith, said vent valve body being biased by a spring in the direction away from the vent valve seat so as to provide a clearance between the vent valve seat and the vent valve body, which allows air bubbles to pass therethrough and which substantially does not allow the liquid under pressure to pass therethrough.

2. An electromagnetic plunger pump as set forth in claim 1, wherein said vent valve rod has a stopper at the end opposite to the vent valve body.

3. An electromagnetic plunger pump as set forth in claim 1, wherein said vent valve body has a conical male tapered surface and said vent valve seat has a conical female tapered surface.

4. An electromagnetic plunger pump as set forth in claim 3, wherein the cone angle of said vent valve seat is greater than the cone angle of said vent valve body.

* * * * *

UNITED STATES PATENT AND TRADEMARK OFFICE

CERTIFICATE OF CORRECTION

PATENT NO. : 4,269,572

DATED : May 26, 1981

INVENTOR(S) : Katsumi Nozawa & Hideo Nomura

It is certified that error appears in the above-identified patent and that said Letters Patent are hereby corrected as shown below:

Column 2, line 52, "incoorporated" should read -- incorporated --.

At Column 6, Claim 1, line 30 "delinering" should read -- delivering --.

Signed and Sealed this

*Eighth* Day of *December 1981*

[SEAL]

*Attest:*

GERALD J. MOSSINGHOFF

*Attesting Officer*

*Commissioner of Patents and Trademarks*